US006663918B2

(12) United States Patent
Manning et al.

(10) Patent No.: US 6,663,918 B2
(45) Date of Patent: Dec. 16, 2003

(54) SPRAYED-IN THICKNESS PATTERNS

(75) Inventors: Timothy Lance Manning, New Richmond, OH (US); Timothy Ray Lattire, Sunman, IN (US); Michael Dwayne Rutter, West Chester, OH (US); Andrew Jay Skoog, West Chester, OH (US); Jane Ann Murphy, Middletown, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/853,228

(22) Filed: May 11, 2001

(65) Prior Publication Data

US 2002/0168479 A1 Nov. 14, 2002

(51) Int. Cl.[7] ..... B05D 1/02; B05D 5/00
(52) U.S. Cl. ..... 427/421; 427/256; 427/287
(58) Field of Search ..... 427/256, 287, 427/421, 422, 427; 118/696, 697, 702, 705, 706

(56) References Cited

U.S. PATENT DOCUMENTS 4,806,390 A * 2/1989 Hawker et al. ..... 427/156
5,645,884 A * 7/1997 Harlow, Jr. et al. ..... 427/8
5,785,901 A * 7/1998 Hasegawa et al. ..... 261/117
5,900,277 A * 5/1999 Fox et al. ..... 427/180
5,900,283 A * 5/1999 Vakil et al. ..... 427/453
5,902,363 A * 5/1999 Connolly et al. ..... 55/487
5,982,095 A * 11/1999 Jin et al. ..... 313/582
6,060,114 A * 5/2000 Sherman et al. ..... 427/130
6,110,262 A * 8/2000 Kircher et al. ..... 106/14.44
6,206,992 B1 * 3/2001 Baek et al. ..... 156/89.11

* cited by examiner

*Primary Examiner*—Shrive P. Beck
*Assistant Examiner*—Eric B. Fuller
(74) *Attorney, Agent, or Firm*—Brian T. Sattizahn; Carmen Santa Maria; McNees Wallace & Nurick LLC

(57) ABSTRACT

A differential thickness pattern can be induced in a coating that is sprayed on an aircraft engine part using a robotic system. The robotic system includes a spray mechanism with a triggering device to spray the coating on the aircraft engine part and a controller. The controller is used to move the spray mechanism along a predetermined path and to activate and deactivate the triggering device. To obtain the differential thickness pattern, a predetermined profile of the aircraft engine part corresponding to areas of the aircraft engine part requiring a thicker coating is integrated into a control program used by the controller. The controller uses the control program to activate and deactivate the triggering mechanism to limit the spraying of the coating to only those areas of the part in the predetermined profile to obtain a different coating thickness.

22 Claims, 1 Drawing Sheet

SPRAYED-IN THICKNESS PATTERNS

STATEMENT REGARDING FEDERALLY SPONSORED RESEARCH OR DEVELOPMENT

This invention was made with support awarded by the U.S. Government and the U.S. Government has certain rights in this invention.

BACKGROUND OF THE INVENTION

The present invention relates generally to the application of coatings to aircraft engine parts. More specifically, the present invention relates to a process for spraying different thicknesses of coating onto an aircraft engine part.

Certain aircraft engine parts can require that selected areas of the part have a coating thickness that is different from other areas of the part. There are currently two different methods for inducing differential thickness patterns into a coating on an engine part.

The first method for inducing a differential thickness pattern into a coating on an engine part is to spray the coating to the thickest required dimension on the engine part and then remove portions of the coating in selected areas of the engine part by sanding or other material removal process to achieve the desired differential thickness pattern of the coating. This method has several drawbacks. One drawback is that significant amounts of coating are being sprayed onto the part only to be subsequently removed, thereby resulting in a waste of coating materials. Another drawback is that the sanding or material removal process can be a very labor intensive and costly process. Still another drawback is that the sanding or material removal process can be inexact. The inexactness of the sanding or material removal process can result in an incorrect differential thickness pattern being induced into the coating or the generation of an undesirable rough transition between the different coating thicknesses.

The second method for inducing a differential thickness pattern into a coating is to construct a shadow mask. The shadow mask is placed on the part and a series of coats of the coating material are applied to the engine part. The shadow mask is then removed and the remaining coats of the coating material are applied to the engine part to achieve the differential thickness pattern in the coating. This method also has several drawbacks. One drawback is that the construction of the shadow mask can be a very costly and labor intensive process. Another drawback is that the use of the shadow mask can be inexact. The inexactness of the shadow mask usage can result in an incorrect differential thickness pattern being induced into the coating or the generation of an undesirable rough transition between the different coating thicknesses.

Therefore, what is needed is a process for accurately spraying differential or non-uniform coating thicknesses onto an aircraft engine part in a single operation.

SUMMARY OF THE INVENTION

The present invention sets forth a method for applying a coating to an aircraft engine component in a repetitive pattern and in a manner to achieve a coating having a preselected thickness in a predetermined location of the component, such that the coating is not uniform across the part. The method utilizes an automated machine that is programmed by selecting a starting point and an end point and one or more intermediate points. The machine stores these points as learned points and applies the coating in accordance with a predetermined program, and along a predetermined path using a modified thickness at any intermediate points as newly learned points.

One embodiment of the present invention is directed to a method for spraying a coating on an aircraft engine part. The method includes providing an aircraft engine part to receive a coating and providing a robotic system comprising a controller and an end effector. The end effector being configured to spray coating material on the aircraft engine part. The controller having a motion plan and a control program to control operation of the end effector to spray a coat of coating material having a predetermined thickness onto the aircraft engine part. A profile of predetermined areas of the aircraft engine part requiring a different thickness of coating is determined and the control program is modified by integrating the profile of the aircraft engine part into the control program to generate a modified control program. The motion plan and the modified control program control the operation of the end effector to spray a coat of coating material having the predetermined thickness on only the predetermined areas of the aircraft engine part in the profile. A pass of the end effector over the aircraft engine part using the motion plan and control program is completed and an additional pass of the end effector over the aircraft engine part is completed using the motion plan and the modified control program. Finally, the steps of completing a pass of the end effector and completing an additional pass of the end effector are repeated until the desired coating has been sprayed on the aircraft engine part.

Another embodiment of the present invention is directed to a method for inducing a differential thickness pattern into a coating on an aircraft engine part. The method includes providing an aircraft engine part to receive a coating and determining the areas of the aircraft engine part requiring a thicker coating. The areas of the aircraft engine part requiring a thicker coating are correlated to points on a predetermined path traveled by a spray mechanism of an automated machine. The points on the predetermined path corresponding to the areas of the aircraft engine part requiring a thicker coating are integrated into a control program for the spray mechanism in the automated machine. The control program is used to move the spray mechanism along the predetermined path and to trigger spraying of the coating by the spray mechanism on the areas of the aircraft engine part requiring a thicker coating. A coat of the coating having a predetermined thickness is sprayed onto the aircraft engine part with the spray mechanism by activating the spray mechanism and moving the spray mechanism along the predetermined path and an additional coat of the coating is sprayed onto preselected areas of the aircraft engine part requiring a thicker coating using the control program to operate the spray mechanism. Finally, the steps of spraying a coat of the coating having a predetermined thickness onto the aircraft engine part and spraying an additional coat of the coating onto preselected areas of the aircraft engine part requiring a thicker coating are repeated until the desired differential thickness pattern has been induced on the aircraft engine part.

Still another embodiment of the present invention is directed to a method for inducing a differential thickness pattern into a coating on an aircraft engine part. The method includes providing an aircraft engine part to receive a coating and determining areas of the aircraft engine part requiring a thicker coating. Next, the areas of the aircraft engine part requiring a thicker coating are correlated to points on a predetermined path traveled by a spray mechanism of an automated machine. The points on the predetermined path corresponding to the areas of the aircraft engine part requiring a thicker coating are integrated into a control program for the spray mechanism. The control program is used to move the spray mechanism along the predetermined path and to trigger spraying of the coating by the spray mechanism. A coat of the coating having a predetermined thickness is then sprayed onto the aircraft engine part followed by the spraying of an additional coat of the coating onto preselected areas of the aircraft engine part requiring a thicker coating. Finally, the steps of spraying a coat of the coating having a predetermined thickness onto the aircraft engine part and spraying an additional coat of the coating onto preselected areas of the aircraft engine part requiring a thicker coating are repeated until the desired differential thickness pattern has been induced on the aircraft engine part.

One advantage of the present invention is that a differential thickness pattern for a coating can be sprayed onto an engine part with extreme accuracy and control.

Another advantage of the present invention is that a coating having different thicknesses can be sprayed onto an engine part quickly, economically and with less wasted coating material.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
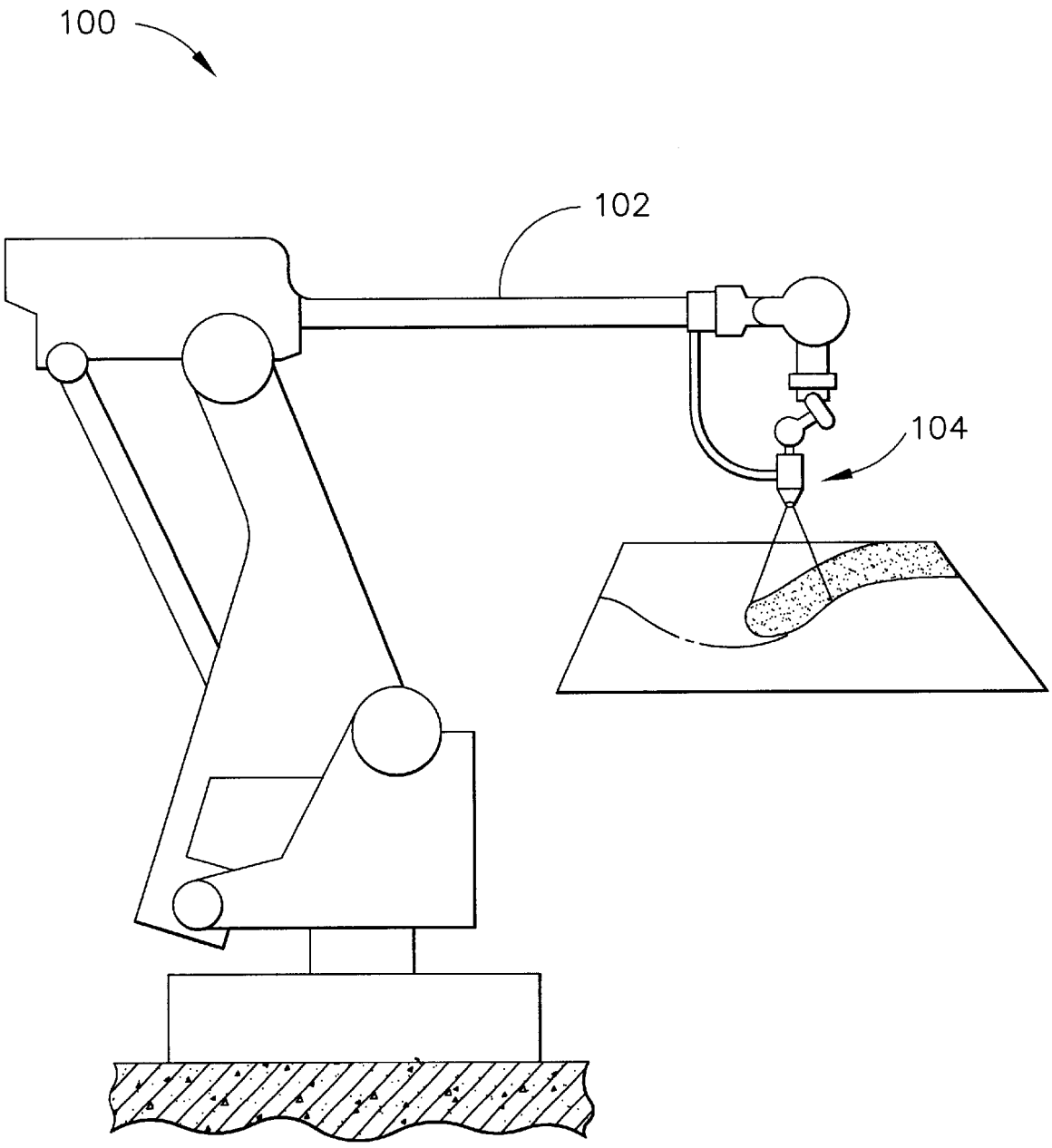
FIG. 1 illustrates a robotic system used in the present invention.

The present invention is directed to a process for inducing a differential thickness pattern into a coating sprayed onto an aircraft engine part. The coating material is preferably a thick ceramic that can be sprayed using alcohol as a carrier, but can also be a polymer or silica based ceramic used with a carrier liquid. The aircraft engine part is preferably an exhaust part that changes planes in a transition from one shape to another, such as from a round shape to a square shape, but can be any engine part that requires a differential thickness pattern in an applied coating. The application of a differential thickness is best suited to locations where there is a transitional change in shape.

The coating is sprayed onto the engine part using an automated machine or robotic system. The operation of the robotic system and the spraying process are preferably performed at ambient temperatures. FIG. 1 illustrates an embodiment of a robotic system 100. The robotic system 100 includes a controller, a robotic arm 102, an end effector 104 connected to an end of the robotic arm 102 and one or more servomotors or servomechanisms to move the robotic arm 102. In a preferred embodiment of the present invention, the end effector 104 is a spray mechanism that can spray the coating onto the aircraft engine part. The spraying of the coating by the spray mechanism 104 is controlled by a triggering device included in the spray mechanism 104. The operation of the triggering device to start and stop the spraying process is controlled by the controller of the robotic system 100. The control signals sent from the controller to the triggering device permit the spraying operation of the spray mechanism 104 to be started and/or stopped at specific points with a high degree of accuracy and control.

During the spraying operation, the spray mechanism 104 is preferably positioned about four (4) inches above the engine part to be coated, but can be positioned at any operable height. In addition, the spray mechanism 104 includes the appropriate nozzles and air flow to have a preferred spray width of about one (1) inch, but other operable spray widths can be used. The preferred one inch spray width is obtained by deactivating any horn air supply to the spray mechanism 104, which still permits atomization of the coating material, but at a narrower width. The spray mechanism 104 also preferably has a substantially constant output spray of coating material.

The controller in the robotic system 100 includes a subroutine or program to implement a motion plan that is used to control the servomotors and robotic arm 102 to move the spray mechanism 104 in a predetermined path over the engine part. The predetermined path is preferably a path that results in the spraying of the coating material, by the spray mechanism 104, onto the entire surface of the engine part that is to receive the coating material, when the movement along the predetermined path is completed. In a preferred embodiment, the predetermined path is a path that has the spray mechanism 104 traveling back and forth between sides of the engine part in a continuous motion such that the spraying operation does not have to be stopped. In one embodiment, the preferred predetermined path is obtained by indexing the spray mechanism 104 about 6.3 mm in the appropriate direction for each trip across the engine part.

In addition to controlling the path of the spray mechanism 104, the controller also controls the speed of travel of the spray mechanism 104 along the path by sending the appropriate signals to the servomotors and robotic arm 102. In a preferred embodiment, the nominal speed of travel of the spray mechanism 104 is about 150 mm/sec, but any operable speed can be used as the nominal speed of travel for the spray mechanism 104. When the spray mechanism 104 has a speed of travel of 150 mm/sec, an 8 mil (0.008 inch) coat of coating material is sprayed onto the engine part by the spray mechanism 104. However, different thicknesses of the coating material can be sprayed onto the engine part by adjusting the speed of travel of the spray mechanism 104. The faster the spray mechanism 104 travels along the predetermined path, the thinner the coat of coating material that is applied to the engine part. Alternatively, the slower the spray mechanism 104 travels along the predetermined path, the thicker the coat of coating material that is applied to the engine part. In another embodiment of the present invention, a different thickness of a coat of the coating material can be obtained by changing the amount of output spray from the spray mechanism 104.

Each time the spray mechanism 104 completes a pass, i.e. has completed traveling along the entire predetermined path, a coat of the coating material is sprayed onto the engine part. The spray mechanism 104 can be repeatedly passed over the engine part to apply additional coats of the coating material until the desired coating thickness is obtained. For example, if the spray mechanism 104 can apply an 8 mil coat of coating material as described above and a 24 mil (0.024 inch) coating of coating material is desired on the engine part, the spray mechanism can be passed over the engine part three times to obtain the 24 mil coating.

When multiple coats of the coating material are being applied to the engine part, an adequate drying time is required between the coats. The adequate drying time permits the carrier or solvent used with the coating material to evaporate from the applied coating. If there is not an adequate drying time between coats of the coating material, blistering of the coating may occur as the solvent vapors are trapped beneath the surface thereby reducing the effectiveness of the coating. In a preferred embodiment of the present invention, the engine part is of a sufficiently large size that by the time the spray mechanism 104 completes a pass, the coat of coating material applied at the beginning of the predetermined path has had adequate time to dry and can receive another coat of the coating material. In other words, in one preferred embodiment, there does not need to be a pause between the application of coats of the coating material for the drying of the coating material because the engine part's large size permits adequate drying during the spraying process.

The controller moves the spray mechanism 104 along the predetermined path and activates the triggering device to start the spraying process, as described above, to apply a coating having a uniform thickness onto the engine part. Then, to obtain the required differential thicknesses of the coating on the engine part, the controller again moves the spray mechanism 104 along the predetermined path to complete a pass, however, the controller activates and deactivates the triggering device at preselected points along the predetermined path to limit the spraying of the coating material to only those areas of the engine part that correspond to a predetermined profile, patch or pattern on the engine part requiring a thicker coating.

When a desired differential thickness coating pattern requires several coats of the coating material to be applied to the entire engine part and additional coats of the coating material to be applied to only the areas of the engine part corresponding to the predetermined profile, the spray mechanism 104 can be operated by the controller to alternate the application of the coats of the coating material between the two different spray patterns. The alternating of the spray patterns results in an interleaving of the coats of the coating and provides a smooth transition between the areas of the coating having different thicknesses.

The predetermined profile for the engine part is integrated into the control program used by the controller and results in the controller activating the triggering device to start the spraying process upon reaching a point along the predetermined path representing an edge of the predetermined profile and then deactivating the triggering device to stop the spraying process upon reaching another point along the predetermined path representing the other edge of the predetermined profile as the spray mechanism 104 is moved along the predetermined path by the controller. If additional coats of the coating material are required in those areas corresponding to the predetermined profile, the controller can repeat the step of moving the spray mechanism 104 while controlling the triggering device until the desired thickness of coating is obtained in the areas of the engine part corresponding to the predetermined profile. In another embodiment of the present invention, the controller can repeat the above process using different predetermined profiles until the desired differential thickness pattern is induced into the coating.

To obtain the predetermined profile to be integrated into a control program used by the controller, a user of the robotic system 100 moves or jogs the spray mechanism 104 along the predetermined path and indicates those points in the predetermined path where the triggering device should be activated or deactivated because edges of the predetermined profile have been reached. After the user has indicated the points corresponding to the predetermined profile, the points can then be integrated into a control program used by the controller with a feedback technique or other suitable technique to operate the triggering mechanism at the appropriate points. If more than one predetermined profile is required to induce the desired differential thickness pattern into the coating, the point entry process described above can be used to obtain the different predetermined profiles, as required.

Another process for obtaining the predetermined profile to be integrated into a control program for the controller is for the user of the robotic system 100 to indicate the points for activation and deactivation of the triggering device in only the first pass and the last pass of the spray mechanism 104 across the engine part from the predetermined path. An interpolation program can then be used to determine the remaining points in the predetermined path using the indicated points and a shape corresponding to the desired predetermined profile. The indicated points and the interpolated points in the predetermined profile are again integrated into a control program for the controller. This process can also be repeated several times to obtain several different predetermined profiles.

Once the predetermined profiles are integrated into the controller, the user of the robotic system 100 only has to enter a few operational parameters and then the robotic system can be operated to apply a coating having a differential thickness pattern in a single operation. Some of the operational parameters that have to be entered include parameters relating to the thickness of a coat of the coating material applied by the spray mechanism 104, the number of times the spray mechanism 104 is moved along the predetermined path to coat the entire area of the engine part and the number of times the spray mechanism 104 has to be moved along the predetermined path to coat only the areas in the predetermined profile.

The controller using the predetermined profile can be used to generate a differential thickness pattern having a 0.0025 inch standard deviation for coating thickness and a 0.1 inch standard deviation for coating position from the ideal differential thickness pattern.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for spraying a coating on an aircraft engine part, the method comprising the steps of:

providing an aircraft engine part to receive a coating, wherein the coating is a ceramic material;

providing a robotic system comprising a controller and an end effector, the end effector being configured to spray coating material on the aircraft engine part, and the controller having a motion plan and a control program to control operation of the end effector to spray a coat of coating material having a predetermined thickness onto the aircraft engine part;

determining a profile of predetermined areas of the aircraft engine part requiring a different thickness of coating;

modifying the control program by integrating the profile of the aircraft engine part into the control program to generate a modified control program, wherein the motion plan and modified control program control operation of the end effector to spray a coat of coating material having the predetermined thickness on only the predetermined areas of the aircraft engine part in the profile;

completing a pass of the end effector over the aircraft engine part using the motion plan and control program;

completing an additional pass of the end effector over the aircraft engine part using the motion plan and the modified control program; and repeating the steps of completing a pass of the end effector and completing an additional pass of the end effector until the desired coating has been sprayed on the aircraft engine part.

2. The method of claim 1 further comprising the steps of:

jogging the end effector over the aircraft engine part according to the motion plan; and indicating the points in the motion plan corresponding to the areas of the aircraft engine part requiring a different thickness of coating.

3. The method of claim 1 further comprising the steps of:

jogging the end effector over the aircraft engine part for a first part and a last part of the motion plan;

indicating points in the first part and the last part of the motion plan corresponding to the areas of the aircraft engine part requiring a different thickness of coating; and interpolating additional points in the motion plan corresponding to the areas of the aircraft engine part requiring a different thickness of coating using the points indicated on the first part and the last part of the motion plan and a predetermined shape for the areas of the aircraft engine part requiring a different thickness of coating.

4. The method of claim 1 wherein the aircraft engine part transitions from a first shape to a second shape and the profile of the aircraft engine part includes at least a portion of an area of the transition from the first shape to the second shape.

5. The method of claim 1 wherein the end effector is configured to spray coating material on the aircraft engine part at a width of 1 inch.

6. The method of claim 1 wherein the motion plan includes an index of 6.3 mm.

7. The method of claim 1 further comprising the step of moving the end effector at a predetermined speed to form a coat of the coating material having the predetermined thickness.

8. The method of claim 7 wherein the predetermined speed is 150 mm/sec and the predetermined thickness is 8 mils.

9. A method for inducing a differential thickness pattern into a coating on an aircraft engine part, the method comprising the steps of:

providing an aircraft engine part to receive a coating, wherein the coating is a ceramic material;

determining areas of the aircraft engine part requiring a thicker coating;

correlating the areas of the aircraft engine part requiring a thicker coating to points on a predetermined path traveled by a spray mechanism of an automated machine;

integrating the points on the predetermined path corresponding to the areas of the aircraft engine part requiring a thicker coating into a control program for the spray mechanism in the automated machine, wherein the control program is used to move the spray mechanism along the predetermined path and to trigger spraying of the coating by the spray mechanism on the areas of the aircraft engine part requiring a thicker coating;

spraying a coat of the coating having a predetermined thickness onto the aircraft engine part with the spray mechanism by activating the spray mechanism and moving the spray mechanism along the predetermined path;

spraying an additional coat of the coating onto preselected areas of the aircraft engine part requiring a thicker coating using the control program to operate the spray mechanism; and repeating the steps of spraying a coat of the coating having a predetermined thickness onto the aircraft engine part and spraying an additional coat of the coating onto preselected areas of the aircraft engine part requiring a thicker coating until the desired differential thickness pattern has been induced on the aircraft engine part.

10. The method of claim 9 further comprising the steps of:

jogging the spray mechanism along the predetermined path; and indicating the points on the predetermined path corresponding to the areas of the aircraft engine part requiring a thicker coating.

11. The method of claim 9 further comprising the steps of:

jogging the spray mechanism along a first part and a last part of the predetermined path;

indicating points on the first part and the last part of the predetermined path corresponding to the areas of the aircraft engine part requiring a thicker coating; and interpolating points on the predetermined path corresponding to the areas of the aircraft engine part requiring a thicker coating using the points indicated on the first part and the last part of the predetermined path and a predetermined shape for the areas of the aircraft engine part requiring a thicker coating.

12. The method of claim 9 wherein the aircraft engine part transitions from a first shape to a second shape and the areas of the aircraft engine part requiring a thicker coating include at least a portion of an area of the transition from the first shape to the second shape.

13. The method of claim 9 wherein the predetermined thickness of the coat of the coating is 8 mils.

14. The method of claim 9 wherein the step of spraying a coat of the coating having a predetermined thickness further comprises the step of moving the spray mechanism at a preselected speed along the predetermined path to form the predetermined thickness of coating.

15. The method of claim 14 wherein the preselected speed is 150 mm/sec.

16. A method for inducing a differential thickness pattern into a coating on an aircraft engine part, the method comprising the steps of:

providing an aircraft engine part to receive a ceramic coating;

determining areas of the aircraft engine part requiring a thicker coating;

correlating the areas of the aircraft engine part requiring a thicker coating to points on a predetermined path traveled by a spray mechanism of an automated machine;

integrating the points on the predetermined path corresponding to the areas of the aircraft engine part requiring a thicker coating into a control program for the spray mechanism, wherein the control program is used to move the spray mechanism along the predetermined path and to trigger spraying of the coating by the spray mechanism;

spraying a coat of the coating having a predetermined thickness onto the aircraft engine part;

spraying an additional coat of the coating onto preselected areas of the aircraft engine part requiring a thicker coating; and repeating the steps of spraying a coat of the coating having a predetermined thickness onto the aircraft engine part and spraying an additional coat of the coating onto preselected areas of the aircraft engine part requiring a thicker coating until the desired differential thickness pattern has been induced on the aircraft engine part.

17. The method of claim 16 wherein the step of spraying a coat of the coating having a predetermined thickness onto the aircraft engine part further comprises the steps of:

activating the spray mechanism with the control program; and moving the spray mechanism along the predetermined path with the control program.

18. The method of claim 16 wherein the step of spraying an additional coat of the coating onto areas of the aircraft engine part further comprises the steps of:

moving the spray mechanism along the predetermined path with the control program; and triggering the spray mechanism at the points integrated into the control program corresponding to the areas requiring a thicker coating to spray coating only on the areas requiring a thicker coating.

19. The method of claim 16 further comprising the steps of:

jogging the spray mechanism along the predetermined path; and indicating the points on the predetermined path corresponding to the areas of the aircraft engine part requiring a thicker coating.

20. The method of claim 16 further comprising the steps of:

jogging the spray mechanism along a first part and a last part of the predetermined path;

indicating points on the first part and the last part of the predetermined path corresponding to the areas of the aircraft engine part requiring a thicker coating; and interpolating points on the predetermined path corresponding to the areas of the aircraft engine part requiring a thicker coating using the points indicated on the first part and the last part of the predetermined path and a predetermined shape for the areas of the aircraft engine part requiring a thicker coating.

21. The method of claim 16 wherein the step of spraying a coat of the coating having a predetermined thickness further comprises the step of moving the spray mechanism at a preselected speed along the predetermined path to form the predetermined thickness of coating.

22. The method of claim 16 wherein the aircraft engine part transitions from a first shape to a second shape and the areas of the aircraft engine part requiring a thicker coating include at least a portion of an area of the transition from the first shape to the second shape.

* * * * *